United States Patent [19]

Shor

[11] Patent Number: 5,009,755

[45] Date of Patent: Apr. 23, 1991

[54] REFINING METHOD

[76] Inventor: Peter S. Shor, 230 East 15th St., New York, N.Y. 10003

[21] Appl. No.: 468,369

[22] Filed: Jan. 22, 1990

[51] Int. Cl.[5] ..... C25C 1/20; C25C 7/00

[52] U.S. Cl. ..... 204/111; 204/252

[58] Field of Search ..... 204/109, 111, 252

[56] References Cited

U.S. PATENT DOCUMENTS 4,895,626 1/1990 Shor ..... 204/111

*Primary Examiner*—T. M. Tufariello

*Attorney, Agent, or Firm*—Wolder, Gross & Bondell

[57] ABSTRACT

A process for purifying and refining gold from wastes and ores is disclosed. The gold to be refined is made the anode in an electroytic cell against an inert cathode. The electrolyte, essentially consists of an impregnated ammonium chloride solution. The impregnant is a nascent-oxygen source for leveling the gold overvoltage at the anode. The cathode is isolated from the gold-containing liquidus by a semi-permeable membrane. The ammonium chloride electrolyte serves as a solvent for the dissolved gold and also complexes with any silver and/or copper commonly found in the impure anode gold. The precipitation of the pure gold at 99.5'% purity is described. The anode is enclosed in an ion permeable bag for collecting any impurities which are insoluble in the gold-containing electrolyte. The pregnant electrolyte, the method and an apparatus for practicing the invention are described.

9 Claims, 1 Drawing Sheet

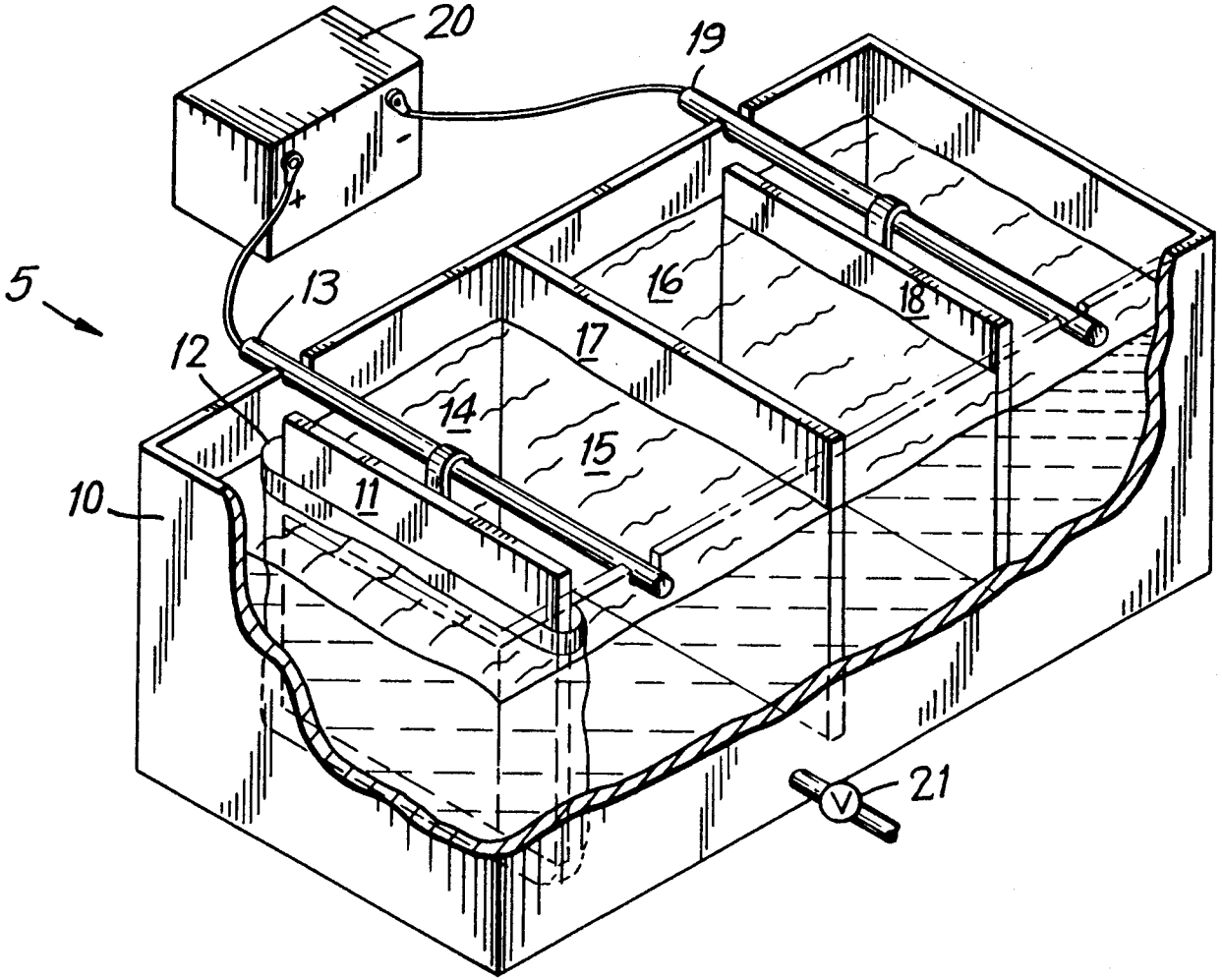
5
10
11
12
13
14
15
16
17
18
19
20
21
-
+
V

REFINING METHOD

FIELD OF THE INVENTION

This invention relates to the electrolytic recovery and purification of gold and particularly to an improvement of my previously patented electrolytes.

BACKGROUND OF THE INVENTION

In my U.S. Pat. No. 4,612,093, issued Sept. 16, 1986, I described my discovery of a gold recovery process based on a novel "pregnant" electrolyte, comprising a halide solution impregnated with a nascent oxygen source. This process is practiced in an electrolytic cell, wherein the gold to be recovered is the anode. The cell cathode is an inert electroconductive substance isolated from the major portion of the electrolyte by a semipermeable membrane. This membrane is permeable to Na ions but not to the electrolysis-dissolved gold contained in the electrolyte. Thus, the gold does not deposit on the cathode but remains in solution. Portions of the electrolyte with the gold solution are removed from the cell and the gold is selectively precipitated by chemical reduction.

Any silver present in the original anode is precipitated as silver chloride. This insoluble compound precipitates in the vicinity of the anode and may be recovered as AgCl.

Any of the platinum group metals commonly used as gold alloying atoms remain in solution after the gold is chemically precipitated from the electrolyte. They can be recovered from the residual solution.

In U.S. Pat. No. 4,612,093 any silver present precipitates at the anode and may be filtered from the gold-containing pregnant electrolyte. In practice, the "pregnant" sodium chloride process is useful when handling small amounts of gold to be electrolyzed over short periods of time. I have found that when the concentration of gold in the electrolyte exceeds about 2–3 oz. per gallon of pregnant electrolyte, the rate of dissolution of the gold in the electrolyte decreases. In fact, even if the gold in the electrolyte is reduced by circulating the electrolyte from the cell and externally precipitating the gold, the rate of gold dissolution at the anode is markedly reduced. I have found that this reduction of gold solution is caused by an accumulation of a film of silver chloride at the surface of the anode. The formation of silver chloride at the surface of the anode physically separates the gold from the solution, slowing dissolution of the gold.

Also, during the use of alkali salts over extended periods, the alkali ions, together with the hydroxyl ions released at the cathode, form alkali hydroxides, such as NaOH in the case of the NaCl pregnant electrolyte, which slowly raise the pH of the electrolyte to such a degree that precipitation of hydroxides of the non-gold metals is encouraged. These extraneous hydroxides often contaminate the gold recovery from the electrolyte in the practice of the previous invention. Further, these precipitates foul the pores of the semi-permeable membrane and thus, over time, reduce the efficiency of the apparatus of that invention.

THE INVENTION

It is thus an object of this invention to provide a process and an electrolyte for this process which overcomes the above shortcomings of my prior invention.

It is a further object of this invention to provide a method for gold purification that avoids silver chloride contamination on the surface of the anode and raising of the pH of the electrolyte during extended operation.

These and ancillary objects and advantages are achieved by my present invention for gold purification and recovery which features novel electrolytes comprising ammonium halide salts and other ammonium-ion sources in sufficient amounts for the ammonium ion to complex with the copper and silver impurities present in the gold anodes being purified. This electrolyte also contains sufficient amounts of "impregnating agents" as sources of nascent oxygen to catalyze the formation of soluble electrolyzed gold chloride from the gold electrolyzed from the anode. The electrolyte further may contain additional highly conductive salts. The electrolyte is maintained at a pH in the range 1–7.0 during electrolysis of the waste gold anode.

It is an ancillary object to provide the process whereby the gold, in anode form, is electrolyzed in said "pregnant" ammonium halide electrolyte to dissolve the gold therein and to complex the silver and copper thereof and to contain and isolate any electrolyte-insoluble impurities from said anode within electrolyte-permeable bags surrounding said anode.

Said process also includes the steps of chemically separating the electrolyzed metallic gold from its solution as gold chloride in the "pregnant" electrolyte.

As a further feature, the present invention includes an apparatus for expeditiously practicing the process of this invention wherein the apparatus described in U.S. Pat. No. 4,612,093, is modified to segregate, in anode bags, the electrolyte-insoluble abrasives and the insoluble platinum-group metal ammonium chloride complexes from the electrolyzed gold-containing, "pregnant" electrolytes including the ammonium-complexed silver and copper.

DETAILED DESCRIPTION OF THE INVENTION

A fuller understanding of the present invention may be achieved upon consideration of the following detailed description thereof taken in conjunction with the annexed Figure which illustrates a form of apparatus for the invention.

The "pregnant" electrolyte of this invention as stated above is an aqueous solution of ammonium chloride ($NH_4Cl$) and contains an "impregnating" agent or anodic catalyst. Ammonium chloride is the preferred conductive ammonium salt for the purpose of this invention, but other ammonium halide salts may be used.

The fluoride is to be avoided as it is much too toxic. Other ammonium salts are also useful as sources of ammonium ion, but their anions often complicate recovery of the gold and the formation of silver and copper ammonium complexes. Ammonium chloride functions best and is the least expensive, highly conductive ammonium salt.

Another reason that ammonium salts are the basis of the "pregnant" electrolyte of this invention is that while ammonium ions permit the formation of gold chloride, they also form silver ammonium complexes and copper ammonium complexes with any silver and copper electrolyzed from the impure anode.

I have also found it useful to include various highly conductive salts in the electrolyte solution. These salts, such as NaCl, augment the conductivity of the electrolyte and permit operation at high current densities.

The electrolyte is rendered "pregnant", i.e. capable of forming gold chloride and maintaining it in solution, by the addition to the electrolyte of an impregnating catalyst. The catalysts that may be used are generally oxidizing catalysts and preferably do not add interfering ions to the electrolyte. Specially preferred are inorganic and organic peroxides. I prefer hydrogen peroxide, but ozone or an ozonide source of nascent oxygen may be used, as well as sodium peroxide, NaOH. Another "pregnating" source is a solution of gold chloride.

The electrolyte becomes fully pregnant when, upon the influence of the catalyst including gold chloride, preferably auric chloride, the electrolyte becomes gold-bearing upon imposition of an electrolyzing current. As little as one part per million of $H_2O_2$ or its equivalent, when added to the ammonium chloride electrolyte, is sufficient when added just prior to the initiation of electrolysis. Similarly, about one milequivalent of gold chloride is sufficient to "impregnate" the electrolyte.

Without the impregnating agents, i.e. the peroxide or gold chloride, the gold does not form electrolyte-soluble compounds and will not function for this invention.

Another feature of this invention is the use of anode bags to surround the anode during electrolysis. The present invention solubilizes the gold from the anode so that the primary precipitating materials from the electrolyzed anodes are the essentially insoluble abrasives included in the "sweepings". Such insoluble materials, include polishing and grinding abrasives, portions of cutting wheels, and the like including various oxides, mixed oxides, nitrides, and carbides of aluminum, silicon, boron, cerium, used for such purposes.

Also, among the insoluble compounds collected in the anode bags used for this invention are the insoluble ammonium complexes of the platinum family of metals, including platinum, ruthenium, rhodium, palladium, osmium, and iridium. Of these, platinum and rhodium are those most commonly found associated with gold in "waste" gold anodes as they are commonly used in jewelry.

This anode "sludge" or "mud" is collected from the anode bags and processed to separate the platinum metals from the abrasives. The latter are discarded and the valuable metals are recovered by further processing in the usual manner.

The presence of the anode bags also offers additional advantages as the bags reduce electrolyte circulation in the vicinity of the anode. This ensures that the catalysts and dissolved gold chloride are maintained at a higher concentration at and near the surface of the anode. As the gold chloride is a very effective impregnating agent, the anode efficiency is markedly increased.

Another benefit of the presence of the permeable anode bags is that a sufficient concentration of ammonium ions at the anode surface is promoted, ensuring complete complexing of the insoluble silver chloride to form the soluble silver ammonium chloride complex. Any augmentation of the ammonium ion in the electrolyte is preferably added into the vicinity of the anode, that is, into the anode bag. Such augmentation is by addition of $NH_4OH$ or concentrated $NH_4Cl$ solutions fed into the anode bags.

The anode bags for this invention are manufactured from any of the materials commonly used for anode bags. These are commercially available. They are usually made from woven and nonwoven polymeric fibers, but natural fibers may also be used.

The invention may be practiced in any cell apparatus fitted with a semi-permeable membrane protecting an inert cathode and permeable anode bags surrounding the gold anodes. As set forth in my aforementioned invention, the semi-permeable cathode protection membrane should have pore sizes of less than $0.5\mu$ (microns). Larger pore sizes permit access of the gold ions to the cathode where the gold deposits. This is inefficient and to be avoided. The smaller pore sizes permit passage of the smaller, highly conductive halide ions while excluding the larger gold ions from the cathode. My U.S. Pat. No. 4,612,093 discloses various semipermeable membranes ranging from regenerated cellulose (Cellophane) to controlled pore size ceramic and powder metallurgy cups. The usual anode bag materials used in the gold industry are satisfactory.

The present invention may also be practiced in a self-contained gold refining apparatus similar to the one described in FIGS. 1 and 2 of my U.S. Pat. No. 4,612,093, modified to include anode bags around the gold anode of that apparatus. The semipermeable membrane of that apparatus is preferably located proximate to the cathode to protect it.

The annexed Figure shows an electrolytic apparatus 5 which may be used for the practice of this invention. It consists of tank 10 of a size adequate for conducting the electrolysis of one or more gold anodes 11 which are contained in an ion-permeable bag 12. The anode 11 is connected to EMF source 20 by positive lead 13, and is immersed in the novel pregnant electrolyte 15 of the invention.

An inert cathode 18, preferably of carbon, is connected by negative lead 19 to the negative pole of the EMF source 20. Positive lead 13 connected to anode 11 is preferably made of copper or silver of sufficient capacity to carry the high amperage used for economic dissolution of the gold. Currents in the range of 100 to 400 amp/ft$^2$ of anode surface are preferred, as they maintain the electrolyte 15 at temperatures in the range of about 160 degrees F. to 180 degrees F. during the electrolysis. The negative lead 19 connecting the inert cathode 18 to the EMF source 20 is not critical as to its composition as it is insoluble during the electrolysis. It need merely be sufficiently conductive to carry the currents used in the electrolysis cell.

The anode 11 used in this process is prepared by melting the gold-containing residues recovered from initial gold refining or from jewelry processing. These residues are heated to form a melt and cast into ingots which will form the anodes 11 used in the apparatus. During the melting process, organic contaminants are decomposed and/or vaporized. Similarly, mercury and zinc are vaporized in that they do not have to be considered during later purification steps. The ingots that become anode 11 are connected to positive lead 13 preferably by either pressure contact or by spot welding. It is preferred not to have the positive lead 13 immersed in the electrolyte 15.

The anode bag 12 is made of a fabric that is ion-permeable and should completely surround the portion of anode 11 immersed in electrolyte 15.

The bag 12 preferably should extend above the level of electrolyte 15 and should be closed at its lower section to ensure containment of any electrolyte-insoluble materials. The anode bag 12 may be made of any of the materials usually used for commercially available anode bags. It may be of woven or non-woven material of natural or synthetic fibers, and should be inexpensive enough so that extreme fines that may accumulate within the fabric can be recovered, after sufficient cycles of emptying the larger particles, by combustion of the bags.

The inert cathode 18 is separated and isolated from a major anode portion 14 of electrolyte 15 by a semipermeable element 17. Thus, the electrolyte is subdivided into a major anode portion 14 and a minor cathode portion 16. The permeability of separator element 17 is selected so that it is essentially impermeable to any gold ions in the anode portion 14 of the electrolyte.

This separation 17 effectively prevents deposition of gold upon the inert cathode 18 during electrolysis. The separator 17 is shown in the figure as a sheet barrier interposed in tank 10 between anode 11 and cathode 18, and should have a pore size between about 0.5μ (micron) and 0.005μ. Above the upper size limit, gold will penetrate through the membrane 17 to plate out on inert cathode 18. Below that size limit, the conductivity through the membrane is significantly decreased, thus reducing the efficiency of the apparatus 5. The semipermeable barrier 17 can be fabricated from ceramic, polymeric or powdered metallurgic processes. The ceramic sheet barriers are fastened and sealed to the sides of tank 11. A variant can be the use of semipermeable cups as the barrier 17, surrounding the inert cathode 18. In such a variant, the cups are filled with the $NH_4Cl$ electrolyte to ensure conductive liquid contact. The use of cups allows the cathode assembly to be removed from the tank, leaving only the anode portion 14 of the electrolyte for subsequent gold recovery. Alternatively, with a fixed sheet barrier a valve 21 can be provided to collect the anode portion 14 for further processing.

Both semipermeable ceramic barriers in the sheet or ceramic cup embodiments are commercially available in the ceramic industry. A semipermeable barrier in the form of a cathode envelope may be manufactured from films of regenerated cellulose or teflonized fabrics. Halo-fluoride-coated fabric for such envelopes to provide a proper degree of semipermeability, is also commercially available. The pore size, within the above stated parameters, is essentially the same for the ceramic, powder metallurgy and semipermeable films form of barrier.

The tank 10 may be any suitable size or material ranging from polymer buckets to large size refining tanks. The anode 11 may be a simple anode or multiple anodes connected to or in contact with the positive lead from the EMF source. The EMF source should also be scaled to the size of the anode to provide the stated amperage at a voltage above at least 1.34 Volts.

The gold is recovered from the electrolyte portion 14 where it accumulates in considerable concentration over extended periods of electrolysis. It is recovered by chemically precipitating the dissolved gold from the portion. The preferred precipitating agent is a selective reducing agent containing sulfite ions. Sodium bisulfite ($NaHSO_3$) is preferred. Most suitable is reagent grade $NaHSO_3$ which yields a metallic gold of 99.5+% purity from the electrolyte. The complexed silver and copper are removed from the remaining solute by adding hydrochloric acid to the complexed silver to break the complex. The silver is then recovered routinely from the AgCl precipitate. The copper may be recovered on metallic zinc.

The anode-precipitated platinum metals which accumulate in the anode bags are recovered from the bags when the mud is periodically removed from the bags. They are recovered as the soluble chlorplatinate group from the insoluble ammonium platinate group complexes.

The waste gold anodes are electrolyzed in the electrolyte which consists of aqueous ammonium chloride (one to two pounds per gallon) in which has been dissolved NaCl (2–4 oz/gal.). The solution is impregnated with the nascent oxygen source, typically about 0.25 fluid ozs. of $H_2O_2$ or about 1 g. $Na_2CO_2$ per gallon, added just before initiation of electrolysis. The electrolyte, during electrolysis, is preferably maintained at about 180 degrees F., but will also work at ambient temperatures. The electrolyzing current is in the range 10–25 amps.

In summary, the present invention differs from my previous invention for gold recovery in utilizing a novel pregnant $NH_4Cl$ electrolyte which dissolves the electrolyzed gold and which complexes and solubilizes any silver and copper in the waste gold anodes. The present invention also provides for the segregation in anode bags of all incidental anode material that is insoluble in the electrolyte.

The present invention is an improvement over my previous invention in that the pregnant electrolyte is primarily an aqueous solution of ammonium chloride also containing the impregnating agent of my previous invention to ensure solubilization of the electrolyzed gold. The electrolyte also may contain conductivity-augmenting ionized compounds and pH controlling agents.

The present invention also includes the improvements within the method for electrolyzing waste gold anodes for gold recovery based upon an impregnated ammonium chloride solution and also includes the steps of segregating the electrolyte-insoluble anode materials in permeable anode bags for removal from the electrolyte and for recovery of any Pt-group metals that may be contained therein.

The method also includes the step of separating and recovering the gold from the pregnant ammonium chloride electrolyte also containing complexed silver and copper. The separation and purification is accomplished by adding reducing sulfites from bisulfites sources to selectively precipitate the gold. A suitable sulfite source is sodium bisulphate. The complexed silver remaining in the ammonium chloride solution is then recovered. The anode bag segregated-precipitates are treated to recover the Pt-group metals precipitated at the anodes by conversion to the clorplatinate group soluble salts.

The present invention also includes improvements in my previous apparatus for gold recovery by providing for the inclusion in such apparatus of ion-permeable anode bags for segregating insolubles from the gold-containing electrolyzed electrolyte solution.

Also said apparatus is improved in efficiency by the utilization, as the electrolyte portion of the apparatus, of the aforesaid pregnant ammonium chloride electrolyte.

As all the above aspects are generically disclosed above, it is understood that all art-recognized equivalent compounds, steps, means, ranges and apparatus are intended which serve the stated purpose of the invention.

I claim:

1. In a halide-electrolyte for electrolyzing gold-containing anodes for gold recovery, wherein said electrolyte consists essentially of an aqueous halide-ion source containing initially an impregnating agent for modifying the electropotential of the metallic gold upon application of electrolysis current and forming a pregnant electrolyte for continuously electrolyzing and dissolving the gold, said impregnating agent being a nascent oxygen source present by volume in said electrolyte in an amount of at least one part per million; the improvement wherein said halide ion source as electrolyte is essentially an aqueous solution of ammonium chloride, to provide sufficient ammonium ions to complex with and to form electrolyte-soluble silver and copper ammonium complexes with any silver and/or copper in said anodes.

2. In the electrolyte according to claim 1, the improvement wherein said pregnant ammonium chloride electrolyte contains additional conductivity augmenting ionic sources.

3. In the electrolyte according to claim 2, the improvement wherein said electrolyte is maintained at about a pH below 7.5 by the use of ammonium chloride.

4. In the method of recovering purified metallic gold from ionic gold solution from a gold-containing anode which comprises the steps of electrolyzing said gold-containing anode by applying an EMF greater than 1.36 volts between said anode and a cathode in a pregnant halide electrolyte, said cathode being isolated from the dissolved ionic gold by surrounding said cathode with a semipermeable membrane impervious to said gold ions, but permeable to said halide electrolyte, the improvement which wherein the step of electrolyzing said anode is in an electrolyte essentially consisting of an aqueous ammonium chloride solution to complex any silver and copper present in said anode as the metal ammonium chloride complexes thereof and to maintain the said gold ions in solution therein.

5. In the method according to claim 4, the improvement wherein the gold anode is enclosed within an ion-permeable anode bag which collects all electrolyte-insoluble components of said gold anode, said components being the platinum group metal ammonium halide complexes and abrasive oxide particles.

6. In the method according to claim 4, the further improvement wherein said dissolved gold is recovered from said electrolyzed ammonium chloride by the addition to said gold-containing ammonium chloride solution of a bisulfite salt selected from the group consisting of bisulfite salts.

7. In the method according to claim 6, wherein, after precipitation and removal of the precipitated gold from the electrolyte, the remaining solute is subjected to recovery of the silver by decomposition of the silver ammonium chloride complex.

8. In the method according to claim 5, wherein the platinum metals are recovered by converting insoluble metal complexes to the respective soluble platinum group chlorplatinates and recovering the pure metal therefrom.

9. In the unitary apparatus for the recovery and purification of gold, said apparatus comprising an electrolysis section, a precipitation section and a utility section, said electrolysis section comprising an EMF source, an electrolyte-containing vessel, an inert cathode, and an anode of the gold to be purified connected to said EMF source, said cathode and anode being immersed in said electrolyte, said electrolyte containing halide ions and a nascent oxygen initiating catalyst for forming soluble auric gold ions; semi-permeable barrier means for segregating the gold ion-containing portion of the electrolyte from the electrolyte portion adjacent to said cathode; said barrier being impermeable to the gold ions, said precipitation section including a vessel wherein the soluble gold-containing solution after electrolysis is contained and provided with means for the addition to said solution of a bisulfite ion source to reduce and precipitate metallic gold in purified form, said utility section containing electric current source means for generating the EMF for said electrolysis section and transfer means for the transfer from storage vessels of said bisulfate ion source to said precipitation section;

the improvement wherein said electrolyte, containing haldide ions, consists essentially of an aqueous ammonium chloride solution the initiating catalyst and conductivity-augmenting ions and further includes within said electrolysis section, means for segregating electrolyte insoluble materials from the electrolyte, said segregating means comprising ion-permeable anode bags; said aqueous ammonium chloride-catalyzed electrolyte dissolving the auric chloride formed at said anode and also complexing and dissolving as the ammonium complex, any silver or copper from said anodes.

* * * * *